US006686945B1

(12) United States Patent
Takizawa et al.

(10) Patent No.: US 6,686,945 B1
(45) Date of Patent: Feb. 3, 2004

(54) THERMAL HEAD, THERMAL HEAD UNIT, AND METHOD OF MANUFACTURE THEREOF

(75) Inventors: Osamu Takizawa, Chiba (JP); Norimitsu Sambongi, Chiba (JP); Noriyoshi Shoji, Chiba (JP); Yuji Nakamura, Chiba (JP); Taro Ito, Chiba (JP); Yumiko Yamaguchi, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 09/762,558

(22) PCT Filed: Aug. 9, 1999

(86) PCT No.: PCT/JP99/04319

§ 371 (c)(1),
(2), (4) Date: Apr. 6, 2001

(87) PCT Pub. No.: WO00/09341

PCT Pub. Date: Feb. 24, 2000

(30) Foreign Application Priority Data

Aug. 11, 1998 (JP) ..... 10-227104
Aug. 20, 1998 (JP) ..... 10-234602

(51) Int. Cl.[7] ..... B41J 2/335; B41J 2/345
(52) U.S. Cl. ..... 347/208
(58) Field of Search ..... 347/200, 209, 347/210, 208

(56) References Cited

FOREIGN PATENT DOCUMENTS

| | | |
|---|---|---|
| EP | 0491388 | 6/1992 |
| EP | 0513660 | 11/1992 |
| EP | 0604816 | 7/1994 |
| FR | 2730666 | 8/1996 |

OTHER PUBLICATIONS

Patent Abstracts of Japan, vol. 013, No. 041 (M–791), Jan. 30 1989 publication No. 63251256, publication date Oct. 18 1988.

Patent Abstracts of Japan, vol. 012, No. 448 (M–768), Nov. 24 1988 publication No. 63179764, publication date Jul. 23 1988.

*Primary Examiner*—Huan Tran
(74) *Attorney, Agent, or Firm*—Adams & Wilks

(57) ABSTRACT

A thermal head has a head chip having an upper surface, a lower surface and a side surface. Heating elements are disposed on the upper surface of the head chip, and electrodes are disposed on the upper surface of the head chip and connected to the heating elements. A wiring substrate is disposed on the lower surface of the head chip. A semiconductor integrated circuit is mounted on the wiring substrate and is in contact with the side surface of the head chip and connected to the electrodes.

28 Claims, 19 Drawing Sheets

THERMAL HEAD, THERMAL HEAD UNIT, AND METHOD OF MANUFACTURE THEREOF

FIELD OF THE INVENTION

1. Technical Field

The present invention relates to a thermal head and a thermal head unit, which are used, for instance, in a miniature portable recording apparatus, a facsimile machine, a printer for tickets and receipts, etc, and also relates to a method of manufacturing the thermal head and the thermal head unit.

2. Background Art

A thermal head includes a head chip in which heating elements arrayed in a row and electrodes connected to these elements are provided on a ceramic substrate, and an IC chip serving as a driver for outputting print signals to selectively generate heat from desired heating elements at desired timings.

FIG. 19 shows an example of a thermal head unit in which the thermal head of this type is mounted onto a heat radiating plate to form a unit. The thermal head unit includes a thermal head 101, and a heat radiating plate 102 made of aluminum or the like. The thermal head 101 is designed such that an electrode 104 and a heating element 105 are formed on a ceramic substrate 103, and an IC chip 106 is further mounted thereon. The electrode 104, a separately provided external terminal 107 for inputting external signals therein, and the IC chip 106.are connected together through bonding wires 108. The IC chip 106 and the bonding wires 108 are molded with sealing resin 109.

To form aboard for the thermal head 101 of this type, a relatively large ceramic substrate 103 is used, and the electrodes 104, the heating elements 105 and the like are formed as thin or thick films on the substrate 103. For this reason, the board obtained by one board forming process is low in number, and thus the productivity is low.

To improve the productivity of the board forming process, it known to provide a composite substrate using a ceramic substrate reduced in size. That is, as shown in FIG. 20, in place of the ceramic substrate 103, a ceramic circuit board 103A and a wiring substrate 103B such as a glass fabric based epoxy resin substrate (hereafter referred to as GE substrate when applicable) are used. In this case, the external terminal 107 is provided on the wiring substrate 103B.

Although this approach makes it possible to improve the productivity of the board forming process, the handling ability is considerably reduced since the ceramic substrate 103A and the wiring substrate 103B are joined to the heat radiating plate 102, and then the IC chip 106 is mounted thereon and the wire bonding is carried out therefor.

In view of the above problems, an object of the present invention is to provide a thermal head, a thermal head unit and a method of manufacturing the same, which can improve the productivity of a board forming process while improving the handling ability of a mounting process, thereby remarkably reducing the cost.

According to a first aspect of the present invention, to solve the above problems, a thermal head is characterized by comprising a head chip having one surface on which heating elements and electrodes connected to the heating elements are provided, and a semiconductor integrated circuit connected to the electrodes, the thermal head characterized in that a wiring substrate is provided, which is joined to the other surface of the head chip, and the semiconductor integrated circuit is mounted to the wiring substrate.

According to a second aspect of the present invention, in the first aspect of the invention, a thermal head is characterized in that one end side of the head chip in a width direction thereof is protruded from the wiring substrate.

According to a third aspect of the present invention, in the second aspect of the invention, a thermal head is characterized in that a protruded amount by which the head chip is protruded from the wiring substrate is 20% to 70% of a width of the head chip.

According to a fourth aspect of the present invention, in the first aspect of the invention, a thermal head is characterized in that the head chip is completely overlapped with and joined onto the wiring substrate.

According to a fifth aspect of the present invention, in the fourth aspect of the invention, a thermal head is characterized in that one end side of the wiring substrate is protruded from one end side of the head chip in a width direction thereof.

According to a sixth aspect of the present invention, in any one of the first to fifth aspects of the invention, a thermal head is characterized in that the semiconductor integrated circuit is mounted onto the wiring substrate to be substantially contacted with an end face of the head chip.

According to a seventh aspect of the present invention, in any one of the first to sixth aspects of the invention, a thermal head is characterized in that a height of a surface of the semiconductor integrated circuit is substantially the same as a height of a surface of the head chip.

According to an eighth aspect of the present invention, in any one of the first to sixth aspects of the invention, a thermal head is characterized in that a height of a surface of the semiconductor integrated circuit is lower than a height of a surface of the head chip.

According to a ninth aspect of the present invention, in any one of the first to eighth aspects of the invention, a thermal head is characterized in that a common electrode is provided, which extends in a longitudinal direction along an end portion of the head chip opposite from the heating elements in a width direction, and connection wirings connecting the common electrode to common electrode wirings provided to the wiring substrate are provided at plural locations in the longitudinal direction.

According to a tenth aspect of the present invention, in the ninth aspect of the invention, a thermal head is characterized in that each of the connection wirings connecting the common electrode provided to the head chip to the common electrode wirings provided to the wiring substrate are provided between physical blocks defined by the semiconductor integrated circuits.

According to an eleventh aspect of the present invention, in the tenth aspect of the invention, a thermal head is characterized in that the connection wirings connecting the common electrode provided to the head chip to the common electrode wirings provided to the wiring substrate are provided for the respective physical blocks defined by the semiconductor integrated circuits.

According to a twelfth aspect of the present invention, in the any one of the ninth to eleventh aspects of the invention, a thermal head is characterized in that at least one connection wiring connecting the common electrode provided to the head chip to a common electrode wiring provided to the wiring substrate is provided within the physical block defined by the semiconductor integrated circuit.

According to a thirteenth aspect of the present invention a thermal head unit is characterized in that the thermal head in any one of the first to twelfth aspects is mounted to a support member.

According to a fourteenth aspect of the present invention, in the thirteenth aspect of the invention, a thermal head unit is characterized in that one end portion of the head chip in the width direction, which serves as a heating element forming portion, is protruded from the wiring substrate, the support member is formed with an upper step portion to which the heating element forming portion is joined, and a step difference portion recessed more deeply than a thickness of the wiring substrate, and an adhesive agent layer is provided in a clearance that is formed between the step difference portion and the wiring substrate when the heating element forming portion of the head chip is joined to the upper step portion.

According to a fifteenth aspect of the present invention, in the fourteenth aspect of the invention, a thermal head unit is characterized in that an adhesive layer is provided for joining the heating element forming portion of the head chip to the upper step portion, and the adhesive agent layer is softer than the adhesive layer after the heating element forming portion is joined to the upper step portion and before the adhesive agent layer is hardened.

According to a sixteenth aspect of the present invention, in any one of the fourteenth to sixteenth aspect of the invention, a thermal head unit is characterized in that an adhesive layer is provided for joining the heating element forming portion of the head chip to the upper step portion, and the adhesive agent layer is thicker than the adhesive layer.

According to a seventeenth aspect of the present invention, in any one of the fourteenth to sixteenth aspect of the invention, a thermal head unit is further characterized in that at least one recessed groove is provided to a bottom portion of the step difference portion.

According to an eighteenth aspect of the present invention, a method of manufacturing a thermal head comprising a ceramic substrate having one surface on which heating elements and electrodes connected to the heating elements are provided, and a wiring substrate joined to the other surface of the head chip, in which a semiconductor integrated circuit is mounted to the wiring substrate, the thermal head manufacturing method characterized by comprising: a step of joining a plurality of the head chips onto a wiring substrate forming plate from which a plurality of the wiring substrate can be obtained; a step of mounting a plurality of the semiconductor integrated circuits to the wiring substrate forming plate; a step of wiring the electrodes on the head chips to the semiconductor integrated circuits; and dividing the wiring substrate forming plates into a plurality of sections.

According to a nineteenth aspect of the present invention, in the eighteenth aspect of the invention, a thermal head manufacturing method is characterized in that the head chips are oriented in one direction, and juxtaposed as a plurality of rows longitudinally and laterally on the wiring substrate forming plate.

According to a twentieth aspect of the present invention, in the nineteenth aspect of the invention, a thermal head manufacturing method is characterized in that a part of the head chips are oriented in a direction perpendicular to the one direction to be joined.

According to a twenty-first aspect of the present invention, in any one of the eighteenth to the twentieth aspect of the invention, a thermal head manufacturing method is characterized in that the wiring substrate forming plate has elongated holes penetrating through the plate, and an inner peripheral surface of the elongated hole forms at least one end face of the wiring substrate.

According to a twenty-second aspect of the present invention, in the twenty-first aspect of the invention, a thermal head manufacturing method is characterized in that the wiring substrate forming plate is designed so that one inner peripheral surface of the elongated hole forms at least one end face of the plural wiring substrates.

According to a twenty-third aspect of the present invention, in the twenty-first or the twenty-second aspect of the invention, a thermal head manufacturing method is characterized in that the head chip extends across both peripheral edge portions of the elongated hole in the width direction, and is joined to only one of the peripheral edge portions.

According to a twenty-fourth aspect of the present invention, in the twenty-first or twenty-second aspect of the invention, a thermal head manufacturing method is characterized in that the head chip is provided so that a part of the head chip in the width direction is confronted with the elongated hole.

According to a twenty-fifth aspect of the present invention, in the twenty-first or twenty-second aspect of the invention, a thermal head manufacturing method is characterized in that the head chip is provided to be located on one of the peripheral edge portions of the elongated hole in the width direction and is not confronted with the elongated hole.

According to a twenty-sixth aspect of the present invention, a method of manufacturing a thermal head unit constructed so that a thermal head is held on a support member, the thermal head comprises a head chip having one surface on which heating elements and electrodes connected to the heating elements are provided, and a wiring substrate that is joined to the other surface of the head chip in a state that one end portion of the head chip in the width direction, which serves as a heating element forming portion, is protruded, and that mounts thereon a semiconductor integrated circuit connected to the electrodes, the thermal head unit manufacturing method characterized by comprising: a step of supplying an adhesive agent layer to a step difference portion of the support member, the support member having an upper step portion joined to the heating element forming portion, and the step difference portion recessed more deeply than a thickness of the wiring substrate; a step of placing the wiring substrate onto the adhesive agent layer provided to the step difference portion using as a reference a joining of the heating element forming portion to the upper step portion prior to hardening of the adhesive agent layer; and a step of subsequently hardening the adhesive agent layer.

According to a twenty-seventh aspect of the present invention, a method of manufacturing a thermal head unit constructed so that a thermal head is held on a support member, the thermal head comprises a head chip having one surface on which heating elements and electrodes connected to the heating elements are provided, and a wiring substrate that is joined to the other surface of the head chip in a state that one end portion of the head chip in the width direction, which serves as a heating element forming portion, is protruded, and that mounts thereon a semiconductor integrated circuit connected to the electrodes, the thermal head manufacturing method characterized by comprising: a step of providing a support member having an upper step portion joined to the heating element forming portion, and a step difference portion recessed more deeply than a thickness of the wiring substrate, and fixing the wiring substrate to the step difference portion using as a reference a joining of the heating element forming portion to the upper step portion while placing the wiring substrate to the step difference portion with a clearance therebetween; a step of supplying an adhesive agent to the clearance; and a step of subsequently hardening the adhesive agent layer.

DETAILED DESCRIPTION OF THE PREFERRED EMBODIMENTS.

Hereafter, the present invention will be described in detail with reference to embodiments thereof.

An Embodiment of a Thermal Head

Figure 1A:
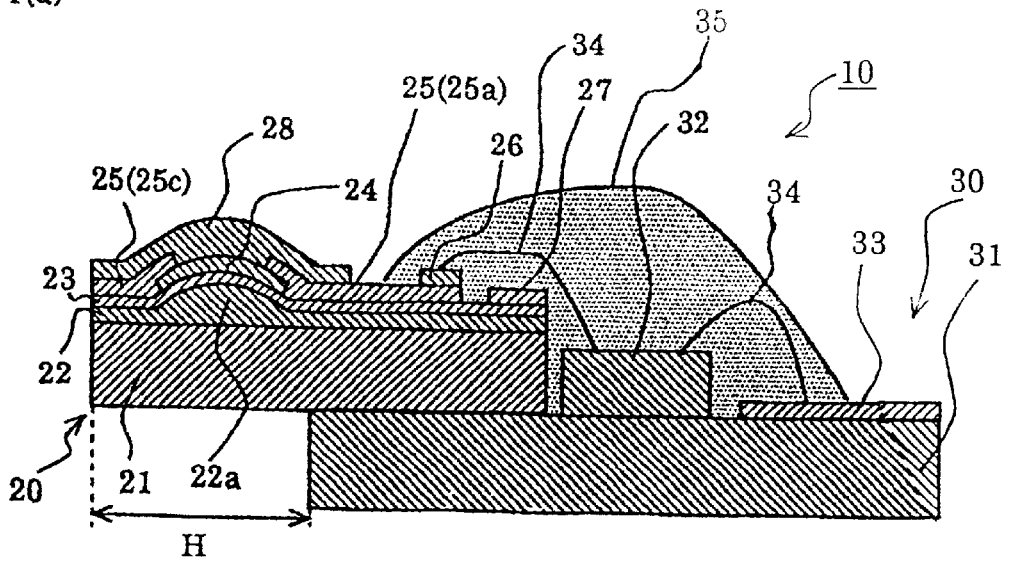
FIGS. 1(*a*) and 1(*b*) are a sectional view and a plane view, respectively, of a thermal head according to an embodiment of the present invention.
Figure 1:
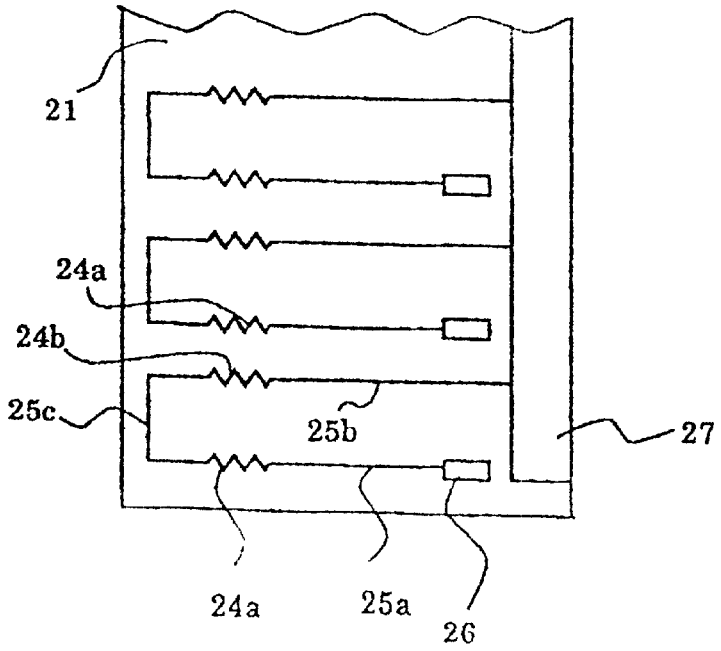

FIG. 1 is a sectional schematic view and a major portion plane view of a thermal head according to an embodiment of the present invention. As shown in FIG. 1(*a*), a thermal head 10 includes a head chip 20 formed with a plurality of thin film layers, and a wiring substrate 30 onto which the head chip 20 is stuck and joined.

The head chip 20 is arranged such that the various thin film layers are formed on a ceramic substrate 21. An under coat layer 23 and a grace layer 22 made of a glass group material having a function of a thermally insulative layer are formed on the ceramic substrate 21. The grace layer 22 has a protruded rib 22*a* having a semicircular shape in section, which is located at a predetermined distance from one end of the ceramic substrate 21. Formed on the area confronted with this protruded rib 22*a* are heating elements 24 intermittently arranged at predetermined intervals in the longitudinal direction thereof. Electrodes 25, made of a metal such as an aluminum, are formed to contact end portions (left and right end portions in the drawing) of the respective heating elements 24 of the ceramic substrate 21. Further, a protective layer 28 is formed on the heating elements 24.

Here, each of the heating elements 24 is made up of a pair of heating elements 24*a* and 24*b*, and electrodes 25*a* and 25*b* are connected to respective end portions of the heating elements 24*a* and 24*b*. The electrode 25*a* serves as a segment electrode, and the end portion thereof is connected to a terminal portion 26 made, for instance, of a gold thin film layer. The electrode 25*b* serves as a common electrode, which is connected to a common electrode 27 that is located on an end portion of the substrate opposite from the heating elements 24. Further, the other end portions of the heating element 25*a* and 25*b* are connected to each other through a U-shaped electrode 25*c*.

The wiring substrate 30 is arranged such that IC chips 32 and external terminals 33 are provided on a substrate 31 such as a GE substrate. The IC chip 32 serves as a driver for outputting drive signals to selectively generate heat from the desired heating elements 24. The IC chip 32 is provided for each of predetermined physical blocks of the heating elements 24. The external terminal 33 serves to input external signals into the respective IC chips 32. The IC chips 32 are connected to the terminal portions 26 and the external terminals 33 through bonding wires 34, respectively. The IC chips 32 and the bonding wires 34 are molded with sealing resin 35.

The thermal head 10 described above is arranged such that the head chip 20 and the wiring substrate 30 serving as a support substrate for the head chip 20 are partially overlapped and jointed to each other so that the IC chip 32 is mounted on the wiring substrate 30. Accordingly, the width (in the right and left direction in the drawing) of the head chip 20 can be remarkably reduced, and therefore the number of the head chips 20 obtained during the board forming process can be increased to improve the productivity. Further, since the head chip 20 and the wiring substrate 30 can be handled in a state that they are joined to each other, the handling ability during the IC chip 32 mounting process is not be lowered. In this case, as described in detail later, the handling ability can be further remarkably increased if the IC chip 32 mounting process and the wire bonding are carried out such that a plurality of head chips 20 are joined onto a wiring substrate forming plate from which a plurality of wiring substrates 30 can be dividingly obtained.

Manufacturing Process

The present invention will be described in further detail by taking an example of a manufacturing process for the thermal head 10 described above.

The operation of a board forming process is basically not different from that in the background art, and therefore will not be described in detail. Note that since the head chip 20 is made small in size, the number of the head chip 20 obtained by one process can be remarkably increased, and thus the productivity can be improved largely.

Figure 2:
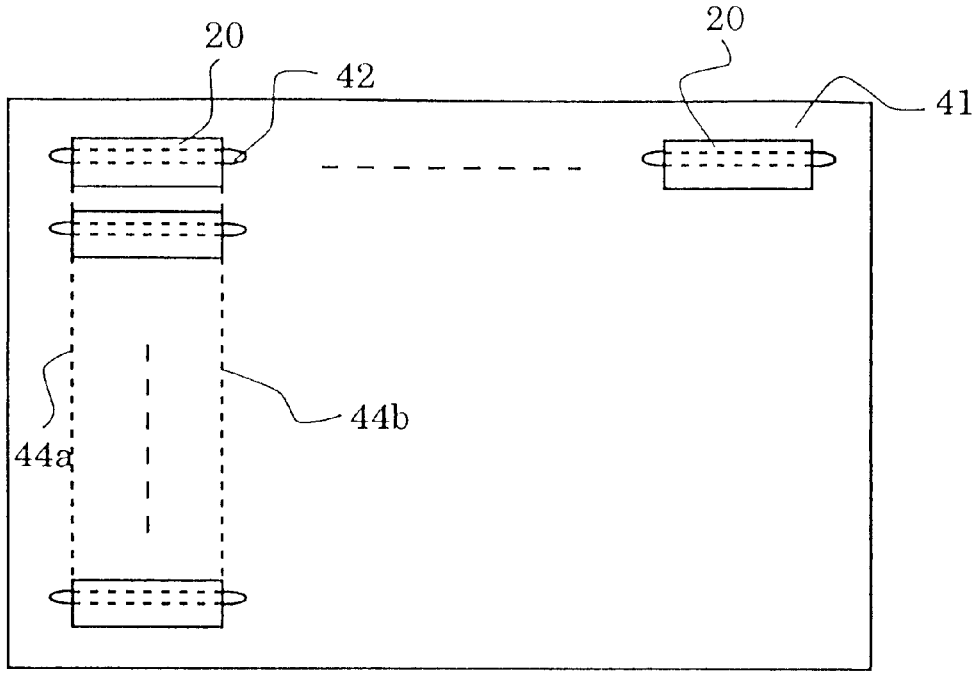
FIG. 2 is a plane view for explaining a manufacturing process of the thermal head according to the embodiment of the present invention.
Figure 3:
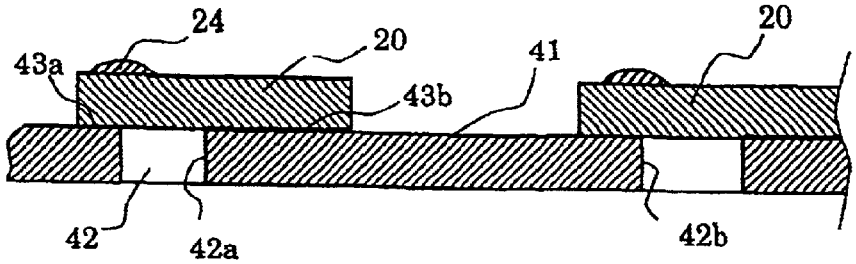
FIGS. 3(*a*)–3(*e*) are sectional views for explaining the manufacturing process of the thermal head according to the embodiment of the present invention.
Figure 3:
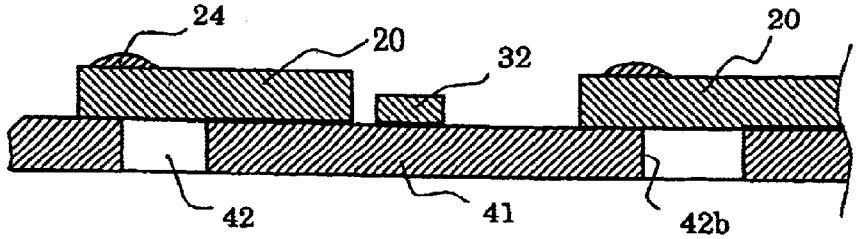
Figure 3:
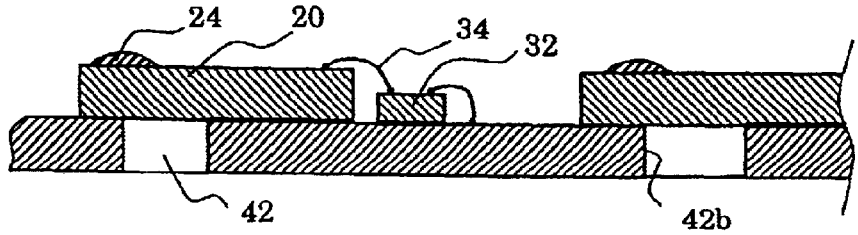
Figure 3:
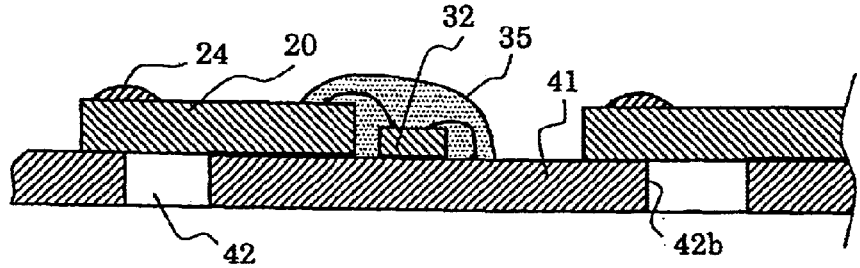
Figure 3:
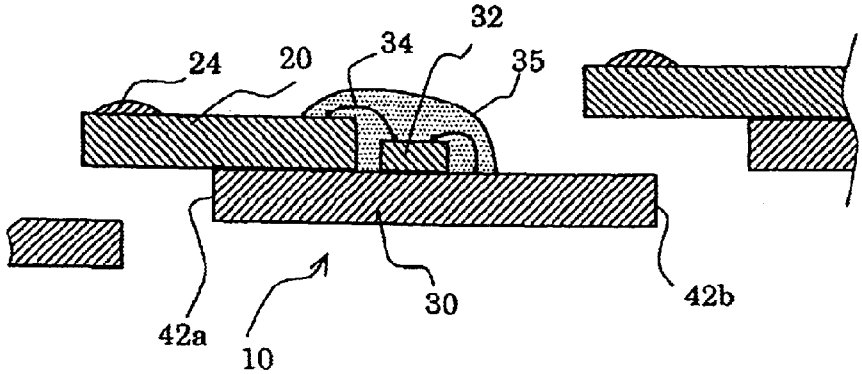

Next, a mounting process will be described with reference to FIGS. 2 and 3. FIG. 2 is a plane view showing an initial stage of the mounting process, and FIG. 3 is a sectional view schematically showing substantially all of the mounting process.

First of all, a plurality of the head chips 20 are joined to a wiring substrate forming plate 41. The wiring substrate forming plate 41 is formed with elongated holes 42 corresponding to locations where the respective head chips 20 are to be joined. The elongated hole 42 is larger in length than the length of the head chip 20, and smaller in width than a protruded length (shown by H in FIG. 1(*a*)) by which the head chip 20 is protruded from the wiring substrate 30. The end of the head chip 20 in the heating element side is disposed to extend along the width direction of the elongated hole 42, and the peripheral edge portion of the elongated hole 42 in the leading end side of the head chip 20 are not joined to the head chip 20. That is, in FIG. 3(*a*), the elongated hole 42 and the head chip 20 are not joined to each other at a boundary 43a between the left side peripheral edge portion of the elongated hole 42 and the head chip 20, and are jointed to each other at a boundary 43*b* between the right side peripheral edge portion thereof and the head chip 20. Accordingly, when the wiring substrate forming plate 41 are divided into the wiring substrates 30 using the elongated holes 42, an inner peripheral surface 42a of the elongated hole 42 in one side of the width direction forms one end surface of the wiring substrate 30, and an inner peripheral surface 42*b* of an adjacent elongated hole 42 in the other side thereof forms the other surface of the wiring substrate 30.

By forming the elongated holes 42 and disposing the head chips 20 across the elongated holes 42, the head chips 20 can be held stably, thereby remarkably improving the handling ability during the mounting process as well as readily forming a structure in which one end portion of the head chip 20 is protruded from the wiring substrate 30.

Here, means for joining the head chip 20 to the wiring substrate forming plate 41 is not specifically limited, but, for example, can be employed such that a tacky agent or an adhesive agent is applied by screen printing, potting, or the like onto predetermined locations of the wiring substrate forming plate 41, and then the head chips 20 are respectively stacked thereon. Alternatively, a method of attaching a double coated tape manually or mechanically may be adopted. A tacky agent is preferably used, which can exhibit fixing force immediately.

During the mounting process, the IC chips 32 are subsequently mounted along the head chips 20 as shown in FIG. 3(*b*).

Figure 4:
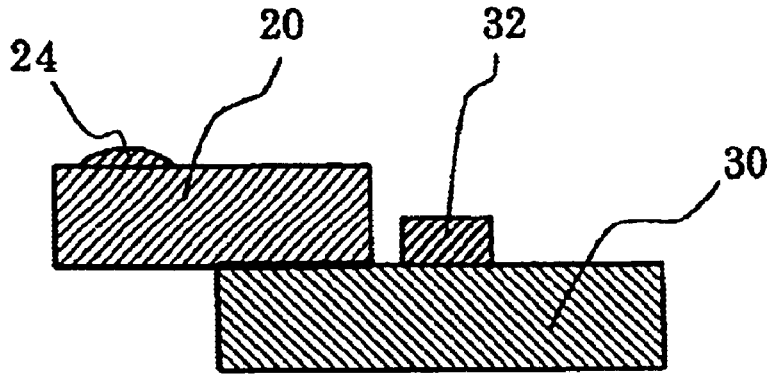
FIGS. 4(*a*)–(*b*) are sectional views for explaining modified examples of the manufacturing process of the thermal head according to the embodiment of the present invention.
Figure 4:
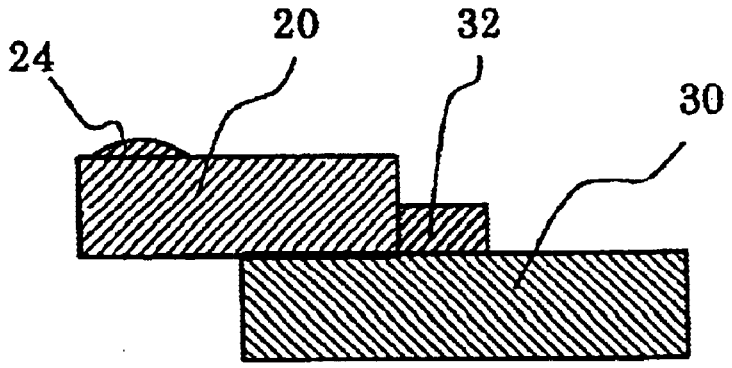

Here, the mounting positions for the IC chips 32 are not specifically limited. As shown in FIG. 4(*a*), the IC chips 32 may be mounted separately from the head chips 20, and as shown in FIGS. 4(*b*), the IC chips 32 may be mounted to closely contact the head chips 20. In the case of FIG. 4(*a*), the IC chips 32 can be mounted easily, whereas in the case of FIG. 4(*b*), the bonding wires 34 described above can be shortened, and the entire thermal head can be made compact.

Subsequently, as shown in FIG. 3(*c*), the IC chips 32 and respective terminals are connected together through the bonding wires 34. Subsequently, as shown in FIG. 3(*d*), the IC chip 32 and the bonding wire 34 are molded with the sealing resin 35. Finally, as shown in FIG. 3(*e*), the wiring substrate forming plate 41 is cut at predetermined locations (along broken lines 44*a* and 44*b* in FIG. 2) to form the thermal heads 10.

Here, the wire bonding, sealing, and cutting steps can be executed using a well known technique. For example, as a cutting method, a method using a rotary blade, a method using a depressing cutter, a punching method using a die set, a cutting method using a router, a cutting method using laser processing, a cutting method using a water jet or the like can be used.

The mounting process as described above is high in productivity and reduces the cost remarkably since the mounting process can be executed in a state that miniature head chips 20 are joined onto the wiring substrate forming plate 41.

In particular, even in a structure in which the head chip 20 is joined to the wiring substrate 30 to be protruded therefrom, the head chip 20 can be held stably using the elongated holes 42 as described above, and the cutting subsequent to the mounting can be conducted easily. For example, in a case where the protruded amount H of the head chip 20 from the wiring substrate 30 of FIG. 1 is 20% or more, preferably 50% or more, of the width of the head chip 20, it is essential to hold the head chip to extend over the elongated holes as described above. In addition, if the protruded amount exceeds 70%, there arises a problem in that the joining strength to the wiring substrate 30 is insufficient.

By adopting a structure in which the end portion of the head chip 20 is protruded from the wiring substrate 30, the reverse side of the heating element forming portions of the head chip 20 is brought into direct contact with a heat radiating plate as described later, and accordingly, the head performance can be improved.

In the mounting process described above, a method of arraying the head chips onto the wiring substrate forming plate is also not limited, and a plate having no elongated hole may be used.

Figure 5:
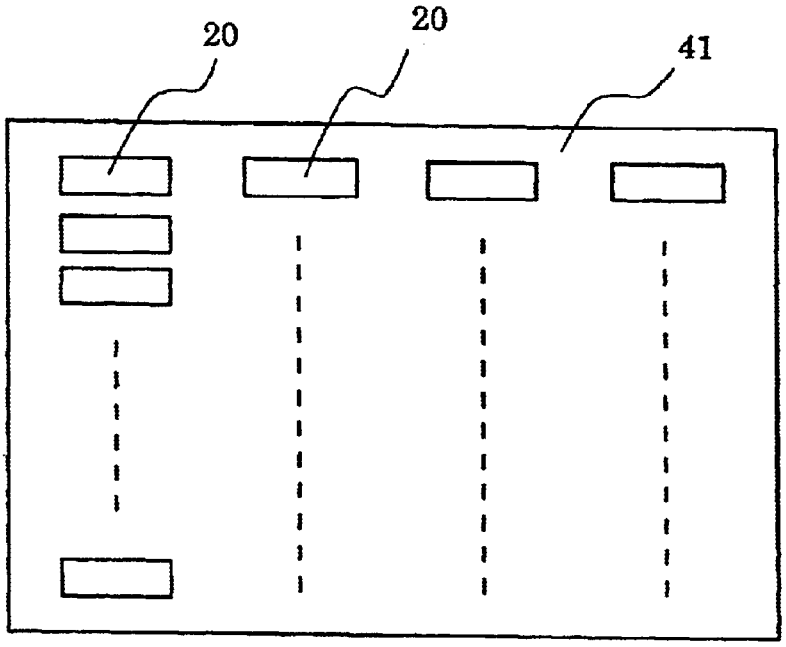
FIGS. 5(*a*)–(*b*) are plane views for explaining modified examples of the manufacturing process of the thermal head according to the embodiment of the present invention.
Figure 5:
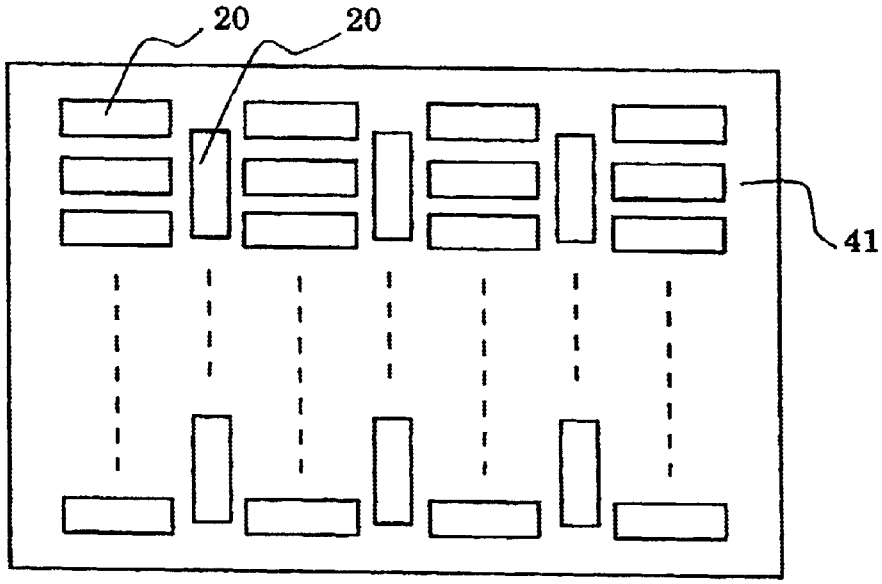

For example, as shown in FIG. 5(*a*), the head chips 20 may be oriented in the same direction and arrayed into a matrix shape, or as shown in FIG. 5(*b*), the head chips 20 oriented in the perpendicular direction may be arrayed in a clearance between adjacent rows in which the head chips 20 are arrayed in the same direction.

Figure 6:
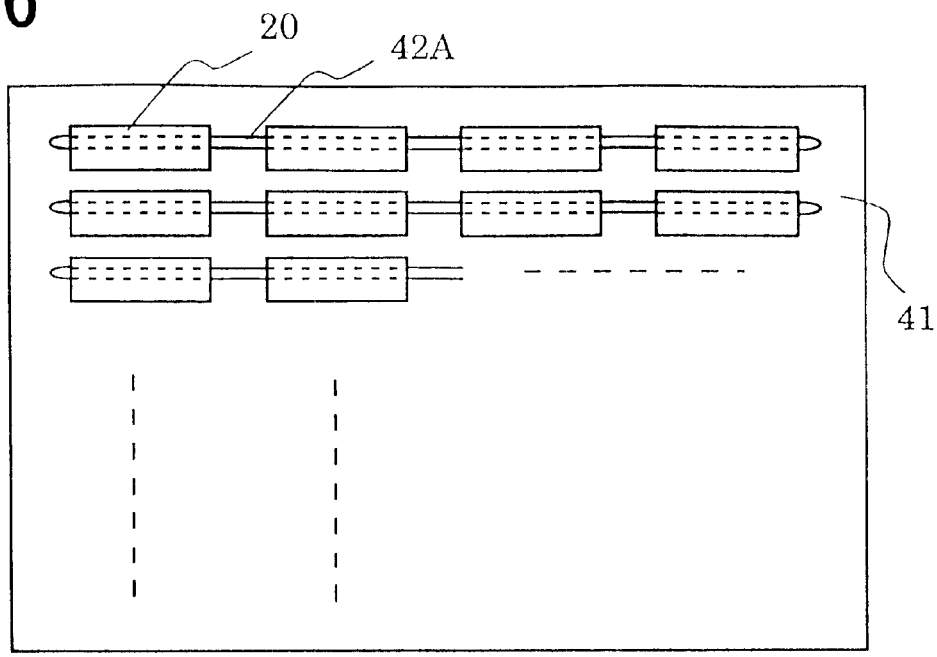
FIG. 6 is a plane view for explaining a modified example of the manufacturing process of the thermal head according to the embodiment of the present invention.

In the case where the elongated holes are provided, a method of forming the elongated holes is not particularly limited. For example, as shown in FIG. 6, a plurality of head chips 20 may be arrayed on the same one elongated hole 42A. In this case, the positioning when the head chips 20 are disposed can be made easy, and this method can cope with the head chips having different lengths.

An Embodiment of a Thermal Head Unit

The thermal head 10 described above is used such that it is held on a support member that is made of a metal such as aluminum and that has a function of a heat radiating plate to form a thermal head unit. An example of the thermal head unit is shown in FIG. 7(*a*).

Figure 7:
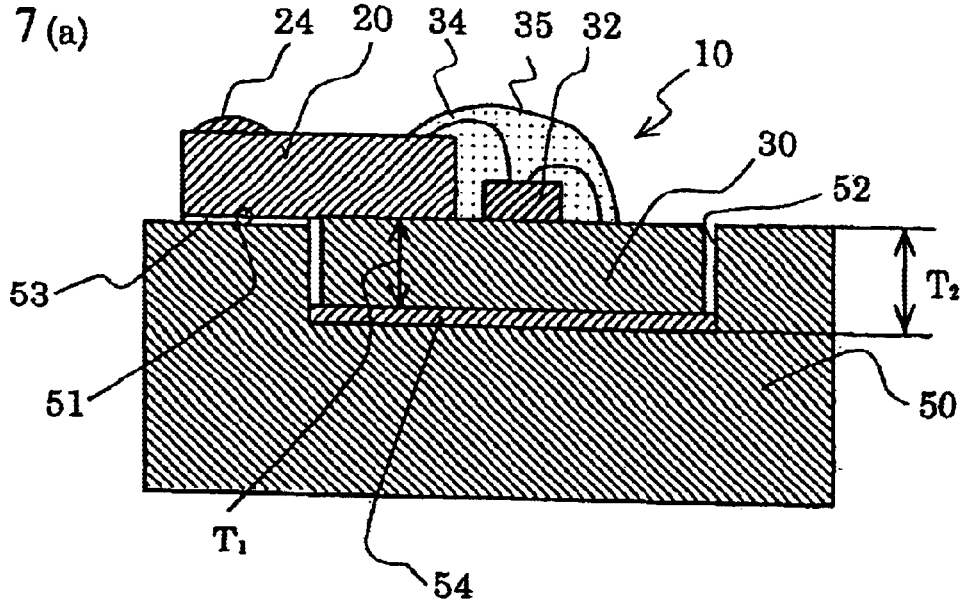
FIGS. 7(*a*)–7(*b*) are sectional views of a thermal head unit according to an embodiment of the present invention.
Figure 7:
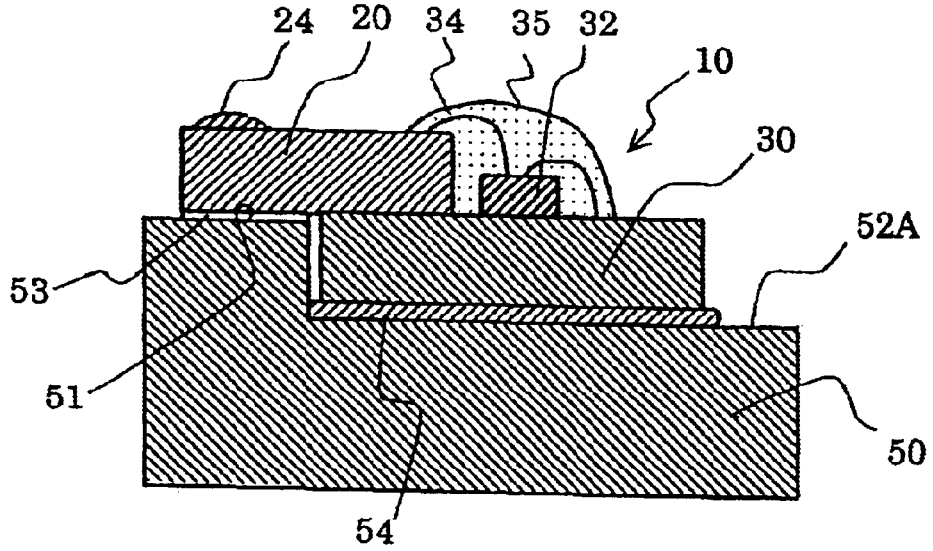

As shown in FIG. 7(*a*), a support member 50 includes an upper step portion 51 serving as a head chip supporting portion which is closely contacted with the reverse side of the end portion of the head chip 20 which is protruded from the wiring substrate 30 and which is provided with the heating elements 24 (hereafter, the end portion being referred to as the heating element forming portion when applicable), and a step difference portion 52 recessed more deeply than the thickness of the wiring substrate 30. The heating element forming portion, i.e. the protruded portion of the head chip 20, is firmly fixed to the upper step portion 51 with an adhesive layer 53, and a bottom portion of the step difference portion 52 is provided with an adhesive agent layer 54. With this arrangement, the support member 50 and wiring substrate 30 are fixed to each other through the adhesive agent layer 54, and the support member 50 and the head chip 20 are fixed to each other through the adhesive layer 53.

Here, it is preferable that prior to the hardening of the adhesive agent layer 54 on the bottom portion of the step difference portion 52, the thermal head 10 is joined by the adhesive layer 53 using as a reference a contact between the reverse surface of the heating element forming portion of the head chip 20 and the upper step portion 51, and then the adhesive agent layer 54 is subjected to the hardening process (heat application, leaving under ambient temperature, irradiation of ultraviolet rays, etc.). This makes it possible to absorb the warp of the wiring substrate 30, such as the GE substrate, by the presence of the adhesive agent layer 54 in a clearance between the wiring substrate 30 and the support member 50, thereby closely fixing both the heating element forming portion of the head chip 20 and the wiring substrate 30 to the support member 50.

It is preferable to use, as the adhesive agent layer 54, an adhesive agent relatively soft when it is unhardened, and this makes it possible to easily realize a thermal head unit structure using, as a reference, a joining surface between the support member 50 and the head chip 20. That is, if, before the adhesive agent layer 54 on the step difference portion 52 is hardened, the heating element forming portion of the head chip 20 and the upper step portion 51 of the support member 50 are joined to each other, and the wiring substrate 30 is placed on the adhesive agent layer 54 within the step difference portion 52, and further if the adhesive agent layer 54 filled in a clearance between the wiring substrate 30 and the step difference portion 52 is a relatively soft material having a flowability or is in the form of a paste, then, even in the case where the clearance is not uniform, a joining surface between the head chip 20 and the upper step portion 51 is not adversely affected, and the joining surface between the head chip 20 and the upper step portion 51 serves as a reference surface. Further, even when a processing for hardening the adhesive agent layer 54 is subsequently executed, the warp of the wiring substrate 30 is absorbed by the adhesive agent layer 54 so that the heating element forming portion of the head chip 20 and the wiring substrate are closely fixed to the support member 50.

As described above, the adhesive agent used as the adhesive agent layer 54 preferably has a flowability or a characteristic having a paste like or soft tacky property when it is unhardened. It is effective to provide the adhesive agent layer 54 thicker than the adhesive layer 53.

In the case of the head chip 20 of this type, if the heating element forming portion, i.e. the portion protruded from the wiring substrate 30, is joined so as to be floated or separated from the support member 50, the excess heat of the heating elements can not be escaped through the support member 50 to adversely affect the printing function. This adverse affect can be eliminated by adopting the support structure described above.

The thermal head aimed at reducing the cost generally employs the GE substrate as the wiring substrate, and in this case also, by adopting the structure described above, it is possible to relieve the stress at the adhering boundary portion caused due to a difference in thermal expansion coefficient, to absorb the warp of the GE substrate due to the hardening process, and thus to provide the sufficient joining strength as well as to eliminate the difficult in assembly.

Here, the support member 50 described above is not specifically limited as far as it includes the step difference portion 52 having a depth T2 (T2>T1) where the thickness of the wiring substrate 30 is denoted by T1. The step difference portion 52 is preferably in the form of a recessed portion for the purpose of preventing the flowing-out of the adhesive agent layer 54 and stably fixing connecting wirings between the circuit formed on the wiring substrate 30 and an unillustrated external driver circuit, but, for example, may be formed as a step difference portion 52A in the form of an L-shape in section as shown in FIG. 7(*b*).

Figure 8:
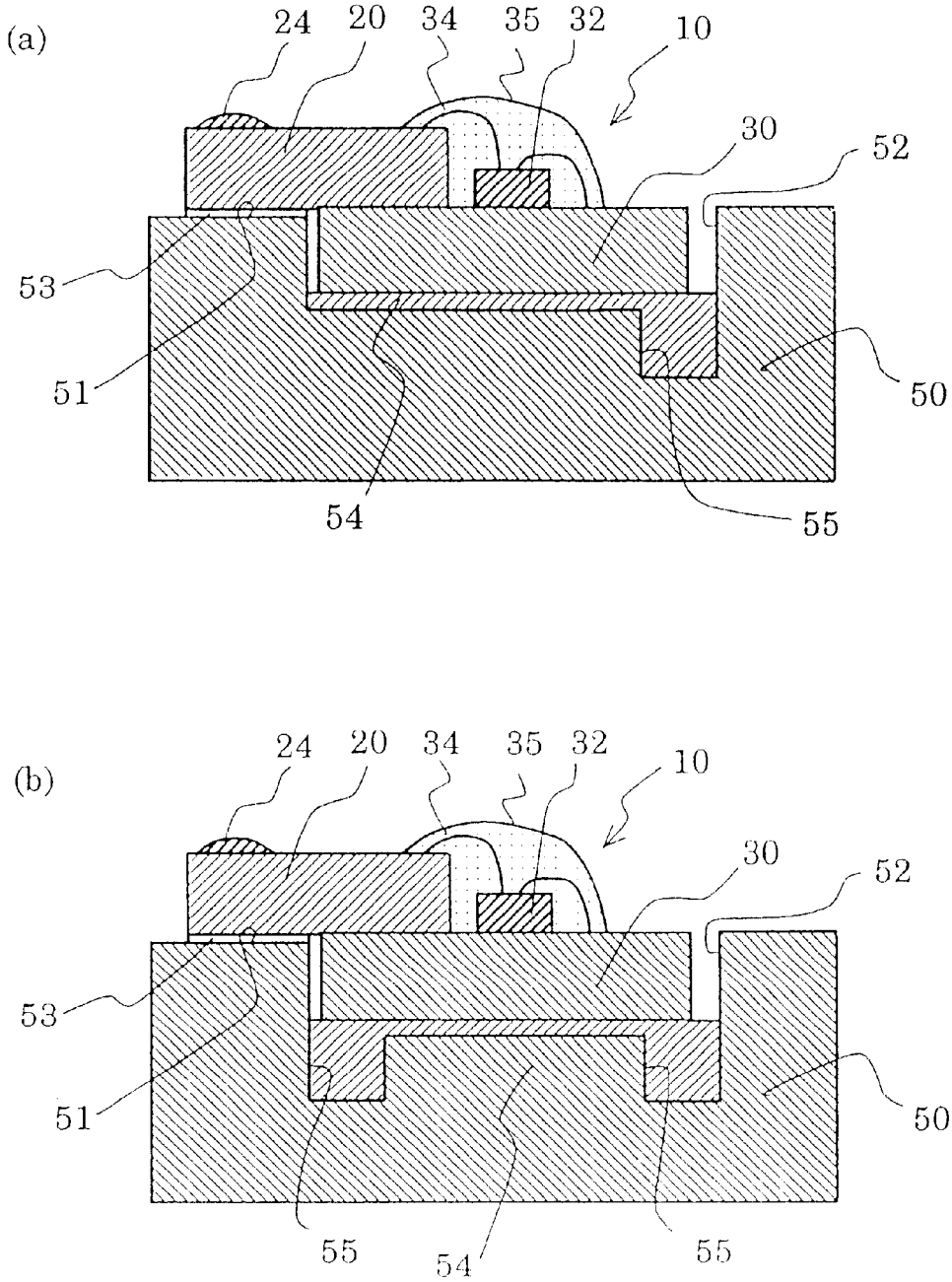
FIGS. 8(*a*)–8(*b*) are sectional views of a thermal head unit according to another embodiment of the present invention.

As shown in FIG. 8, a groove 55 may be provided to the bottom portion of the step difference portion 52 to form a relief portion for the adhesive agent layer 54, thereby further preventing the adhesive agent layer 54 from flowing out to the surface of the support member 50. Of course, the groove portion 55 is not limited in number, shape, etc, and as shown in FIG. 8(*a*) one groove 55 may be provided, and alternatively, two or more grooves 55 may be provided. Further, the groove 55 may be rectangular in section, or otherwise may be semicircular in section.

The adhesive layer 53 for joining the head chip 20 to the upper step portion 51 of the support member 50 is not limited as far as it can securely establish a closely contacting state for releasing the excess heat of the heating element forming portion, and a double coated tape, a tacky agent, or an adhesive agent can be used to form the adhesive layer 53.

A method of providing the adhesive agent layer 54 to the bottom portion of the step difference portion 52 is not specifically limited. For example, a printing using a metal mask having a durability and which is effective with respect to a step difference is preferable, but an injection method using a dispenser may be adopted. Another material such as a sheet-like tacky agent may be used as far as it can absorbs the warp of the GE substrate and the difference in thermal expansion coefficient.

A method of mounting the thermal head 10 to the support member 50 is not specifically limited. For example, after the adhesive layer 53 and the adhesive agent layer 54 as described above are prepared, the support member 50 is set onto a jig, and the thermal head 10 is placed on the support member 50 to match with each other while using the heating element forming portion of the head chip 20 as a reference.

It is also applicable to respectively add positioning marks to the support member 50 and the thermal head 10, to execute recognition and positioning using the positioning marks and to thereby place the thermal head onto the support member 50. After the heating element forming portion of the head chip 20 and the wiring substrate 30 are simultaneously depressed onto the support member 50 to be securely contacted therewith, the hardening process for hardening the adhesive agent layer 54 is executed. As another method, after the support member 50 is placed onto the thermal head 10 using the heating element forming portion of the head chip 20 as a reference, an adhesive agent can be allowed to flow into a clearance between the wiring substrate 30 and the step difference portion 52 of the support member 50, and then the process for hardening the adhesive agent can be executed to closely contacting and fixing the thermal head 10 onto the support member 50.

Another Embodiment of the Thermal Head

Figure 9:
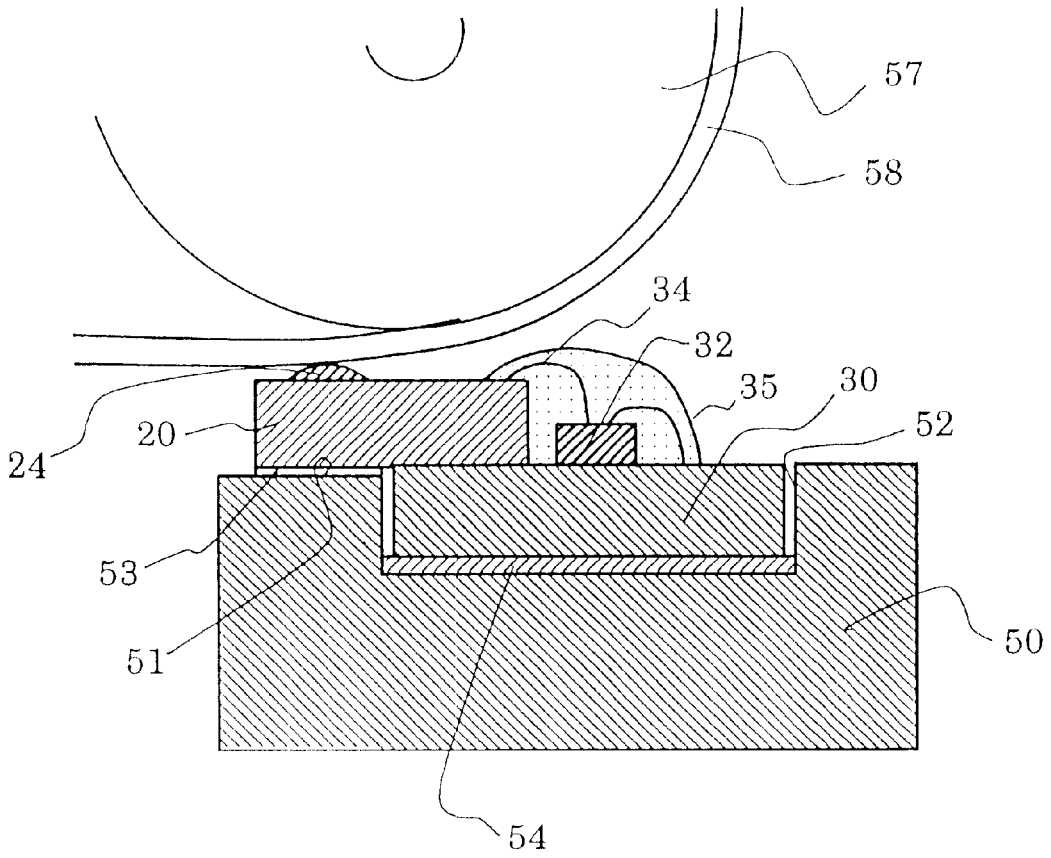
FIG. 9 is a sectional view for explaining an effect obtained by the embodiment of the present invention.

Various advantages of the thermal head 10 thus constructed have been discussed. By stacking and joining the head chip 20 onto the wiring substrate 30 and mounting the IC chips 32 onto the wiring substrate 30, each of the IC chips 32 can be located at a relatively lower position in comparison to the structure of the background art. Therefore, the height of the sealing resin 35 can be reduced. This provides an advantage in that, when the head is actually mounted to a thermal printer or the like, it is possible to readily secure a conveying space for a printed sheet. That is, as shown in FIG. 9, a clearance between a platen roller 57 disposed opposite to the heating elements 24 and the sealing resin 35 can be enlarged to avoid the interference between the printed sheet 58 and the sealing resin 35.

In order to obtain this effect, it is preferable to use the IC chip 32 having a height smaller than a thickness of the head chip 20, but the invention should not be limited thereto, and the similar effect can be obtained if the height of the IC chip 32 is substantially as large as the thickness of the head chip 20.

Figure 10:
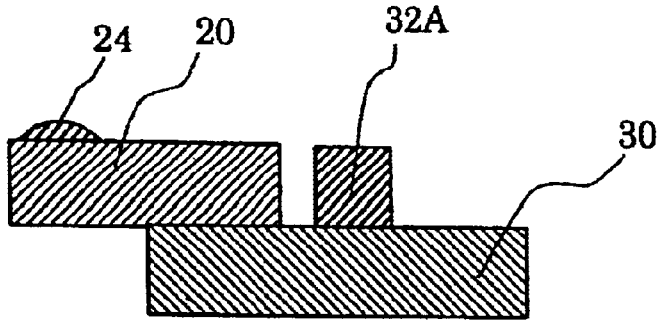
FIGS. 10(*a*)–10(*c*) are sectional views of modified examples of the thermal head according to the embodiment of the present invention.
Figure 10:
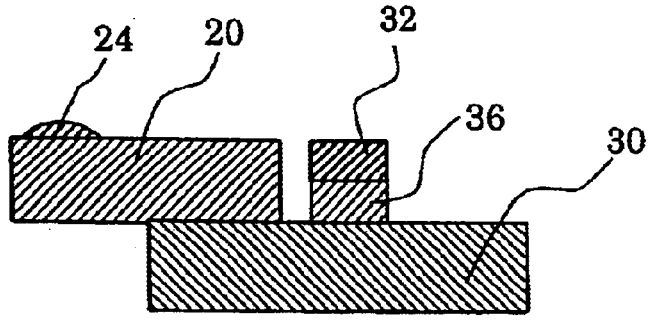
Figure 10:
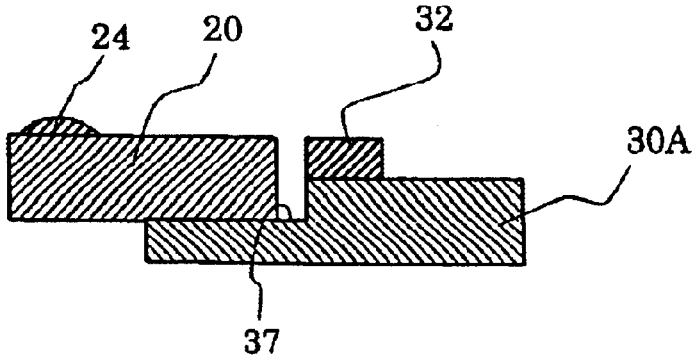

For example, as shown in FIG. 10(*a*), the IC chip 32A having a height substantially as large as the thickness of the head chip 20 may be used, and as shown in FIG. 10(*b*), a base portion 36 may be provided below the IC chip 32 so that the height of the IC chip 32 is as large as the thickness of the head chip 20, and further, as shown in FIG. 10(*c*), using a wiring substrate 30A having a step difference portion 37 relatively thinner in a joining portion to the head chip 20, the height of the IC chip 32 may be as large as the thickness of the head chip 20. If the thickness of the head chip 20 is set to be substantially the same as the height of the IC chip 32 as described above, the wire bonding process can be facilitated.

Figure 11:
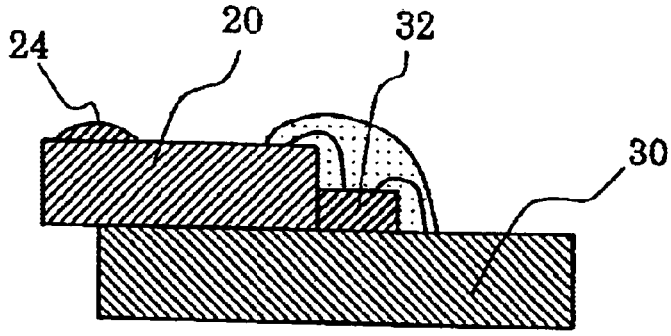
FIGS. 11(*a*)–11(*c*) are sectional views of modified examples of the thermal head according to the embodiment of the present invention.
Figure 11:
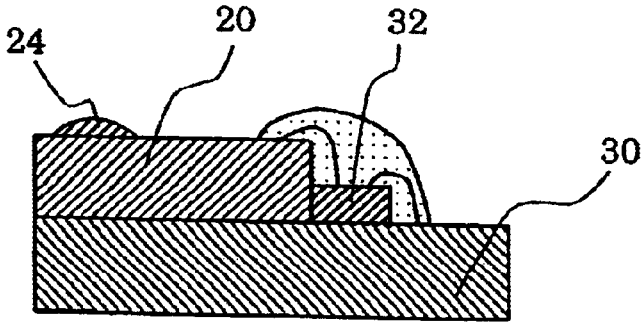
Figure 11:
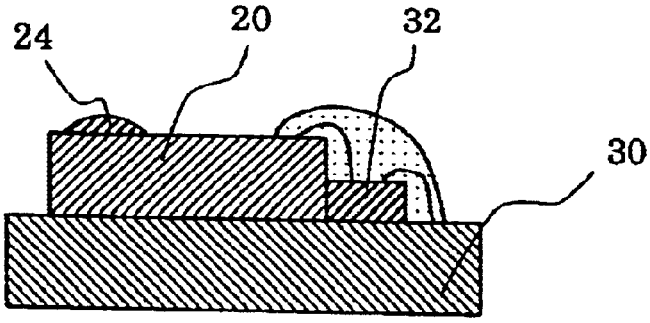

The joining state between the head chip 20 and the wiring substrate 30 is not specifically limited. As shown in FIG. 11(*a*), even in the case where the head chip 20 is protruded from the wiring substrate 30 as in the embodiments described above, the portion where the heating elements are provided may not be protruded entirely, and as shown in FIG. 11(*b*), the end face of the head chip 20 may be flush with the end face of the wiring substrate 30, and further as shown in FIG. 11(*c*), the end face of the head chip 20 may be located inwardly of the end face of the wiring substrate 30. Either of these cases is disadvantageous in view of releasing the head of the heating element forming portion, but advantageous in that the mounting is stable, and the head is made as compact as possible. The case where the end face of the head chip 20 is retracted from the end face of the wiring substrate 30 as shown in FIG. 11(*c*) is advantageous in that the end portion of the head chip 20 is prevented from being damaged due to contact or the like.

Figure 12:
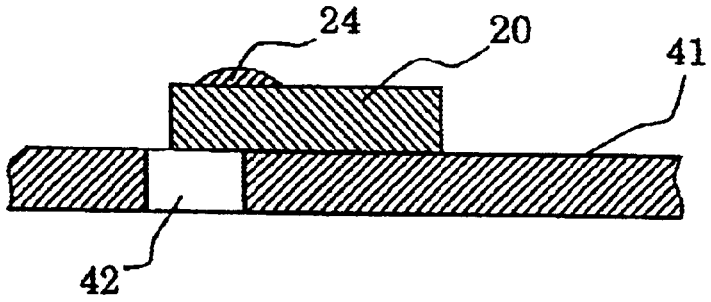
FIGS. 12(*a*)–(*c*) are sectional views for explaining modified examples of the manufacturing process of the thermal head according to the embodiment of the present invention.
Figure 12:
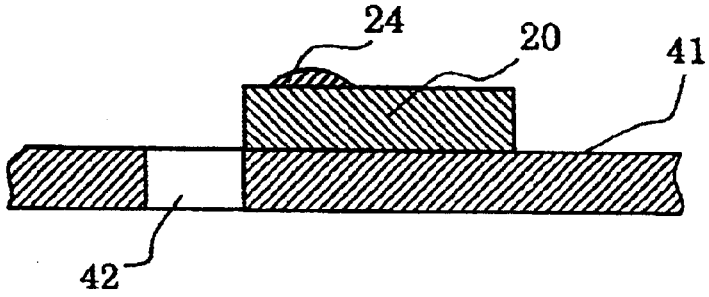
Figure 12:
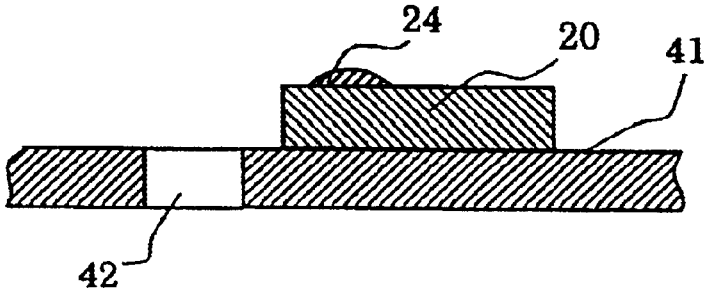

Further, to manufacture the thermal heads of these structures, the wiring substrate forming plate 41 onto which the head chips 20 are mounted may not be formed with the elongated holes 42 as mentioned above, but it is preferable to form the elongated holes 42 for the purpose of facilitating the cutting process. A positional relationship between the elongated hole 42 and the head chip 20 when the head chip 20 is mounted is not specifically limited. As shown in FIG. 12(*a*), the end face of the head chip 20 may be confronted with the interior of the elongated hole 42, as shown in FIG. 12(*b*), the end face of the head chip 20 may be flush with the inner peripheral surface of the elongated hole 42, and further as shown in FIG. 12(*c*), the end face of the head chip 20 may be separated from the elongated hole 42. In this case, the head chip 20 can be stably mounted, and the mounting without mutual inclination can be readily realized.

A Wiring Arrangement of the Thermal Head

In the case of the thermal head as described above, in order to make the head chip 20 compact in size, it is required to suppress the width of the common electrode 27 shown in FIG. 1 to a minimal level. In general, the common electrode 27 is connected, for example, at both end portions thereof through common electrode wirings provided on the wiring substrate 30 to external terminals and then grounded. However, in this case, the electric resistance possessed by the common electrode 27 causes variation in the value of current flowing through the respective heating elements 24. That is, the value of current flowing through the heating element 24 connected to a central portion remote from the grounded portion of the common electrode 27 is small to make the generated heat amount small, thereby causing variation in print density.

Therefore, the thermal head according to the present embodiment uses the common electrode 27 the width of which is suppressed to the minimal level in order to make the width of the ceramic substrate 21 the smallest, as well as improving the connection of the common electrode 27 to the external terminals in order to eliminate the variations in print density among the respective heating elements 24.

Figure 13:
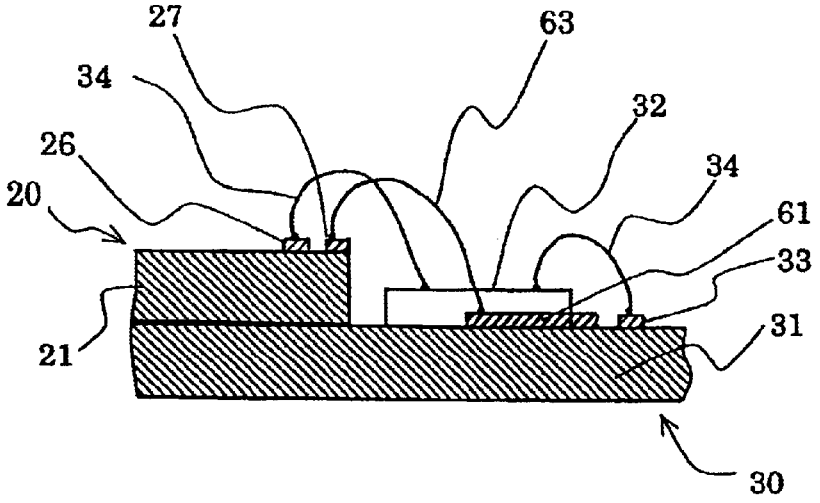
FIGS. 13(*a*)–(*b*) are a sectional view and a plane view, respectively, of wiring connection portions between a head chip and a wiring substrate in the thermal head according to the embodiment of the present invention.
Figure 13:
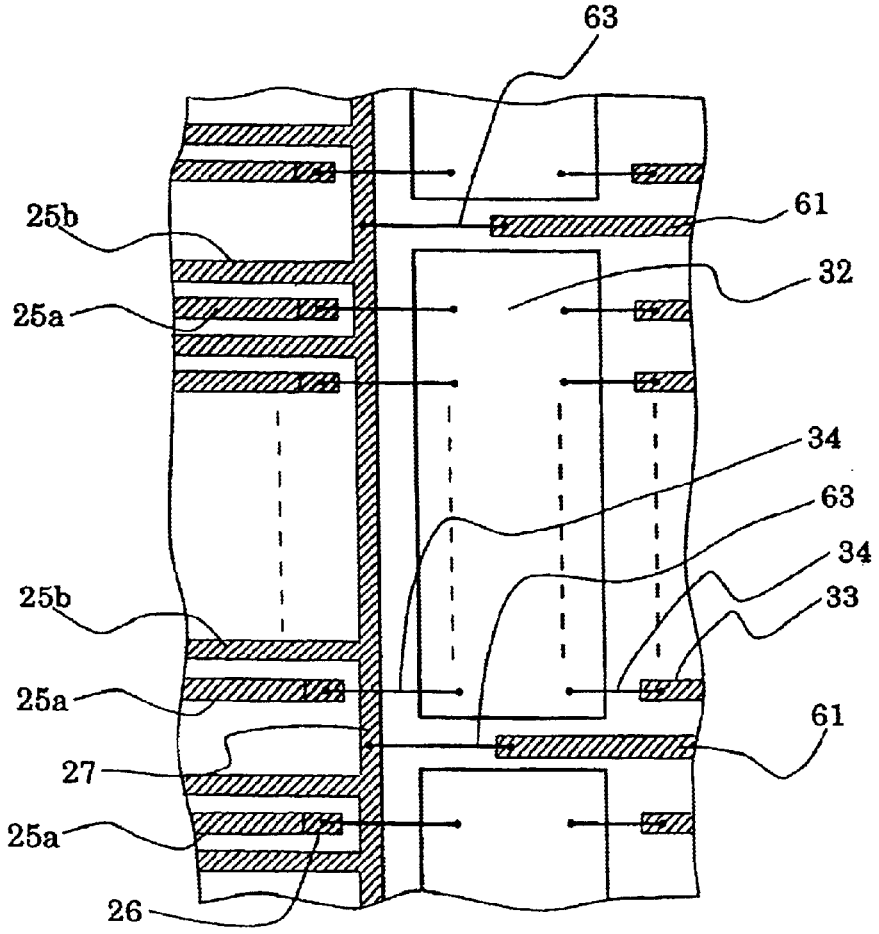

FIG. 13(*a*) is a sectional view of a wiring connecting portion between the common electrode 27 of the head chip 20 and the common electrode wirings of the wiring substrate 30, and FIG. 13(*b*) is a plane view thereof.

As shown in these drawings, the wiring substrate 30 is provided with the common electrode wirings 61 so that the common electrode wirings 61 extend to the area between the adjacent IC chips 32, and these common electrode wirings 61 and the common electrode 27 provided to the end portion of the ceramic substrate 21 are connected through the bonding wires 63, respectively. Each of the common electrode wirings 61 is grounded through an unillustrated external terminal. That is, in the present embodiment, the common electrode 27 is connected to the common electrode wiring 61 at each of physical blocks defined by the respective IC chips 32.

Accordingly, since the connection between the common electrode 27 and the common electrode wiring 61 of the wiring substrate 30 is provided at each of the physical blocks defined by the respective IC chips 32, it is possible to reduce the variation in print density caused due to the electric resistance of the common electrode 27. That is, it is possible to reduce the variation in the value of current flowing through the heating elements, to thereby make uniform the quantity of the heat generated from the heating elements.

Figure 14:
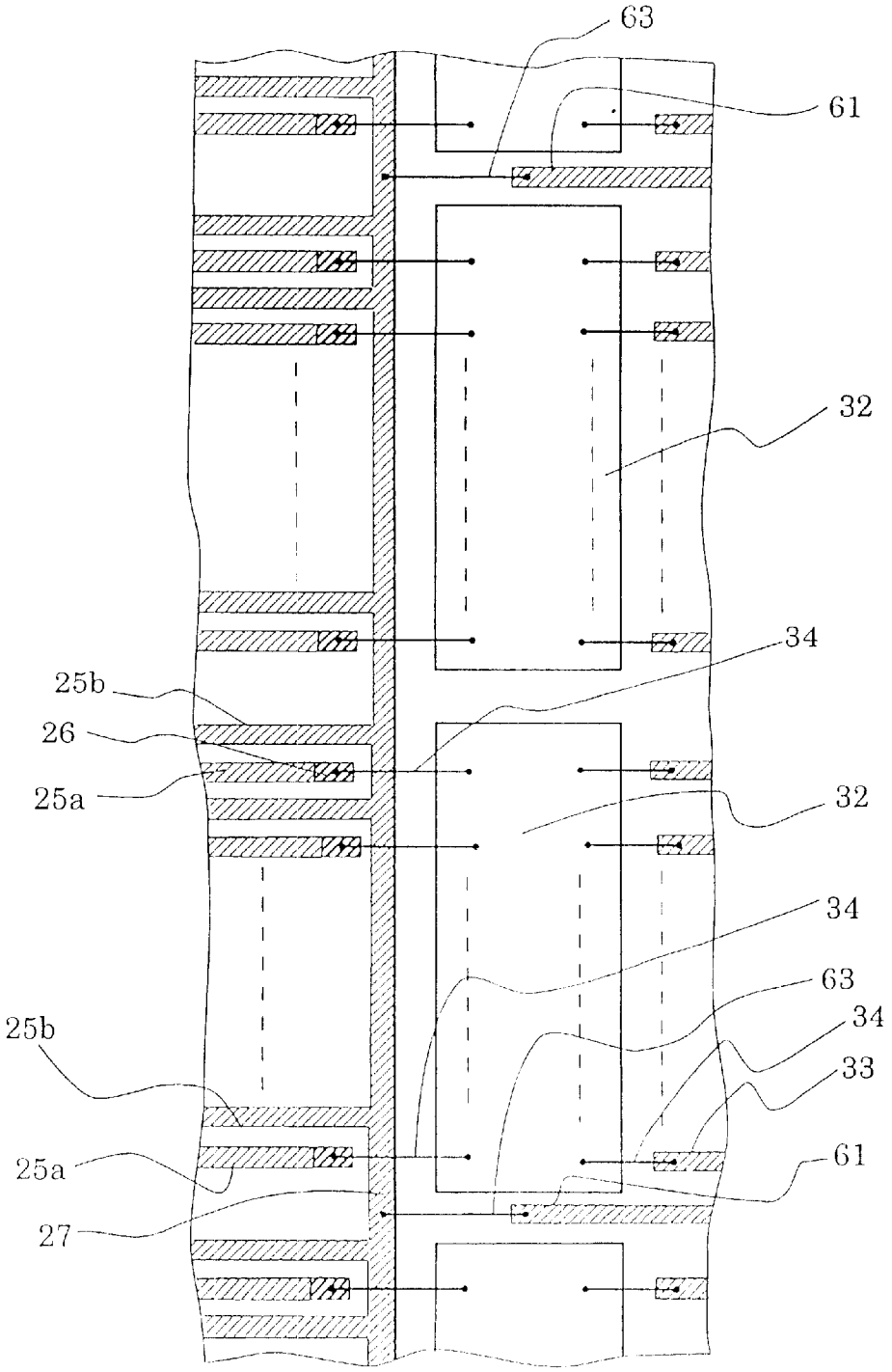
FIG. 14 is a plane view of a modified example of a wiring structure according to the embodiment of the present invention.

The number of the common electrode wirings 61 can be determined based on the electric resistance of the common electrode 27, the voltage applied during printing, the number of the heating elements connected to the IC chip 32, the electric resistance of the heating element, or the like. For example, as shown in FIG. 14, each of the common electrode wirings 32 may be provided for two of the IC chips 32, or a multiple, i.e. three or more, IC chips 32.

Figure 15:
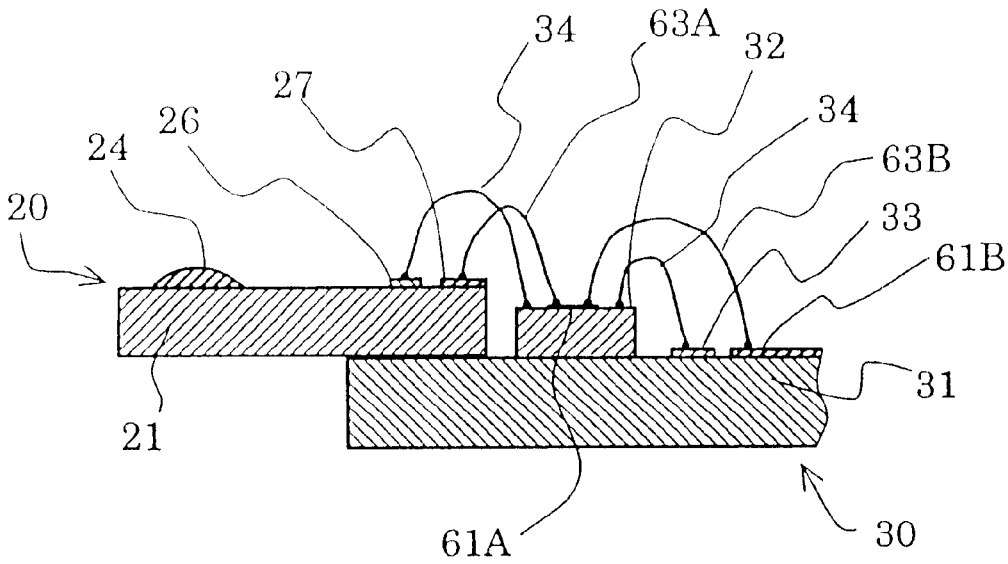
FIG. 15 is a sectional view of a modified example of the wiring connection portions between the head chip and the wiring substrate in the thermal head according to the embodiment of the present invention.

The plural connections between the common electrode 27 of the ceramic substrate 21 and the common electrode wirings 61 of the wiring substrate 30 are provided within each physical block. That is, in the present embodiment, as shown in FIG. 15, further provided are a common electrode wiring 61A on the surface of substantially the central portion of the IC chip 32, and a common electrode wiring 61B associated therewith, and bonding wires 63A and 63B respectively connecting the common electrode 27 to the common electrode wiring 61A and the common electrode wiring 61A to the common electrode wiring 61B. Other arrangements are the same as those of the embodiments described above. In addition to the connection between the common electrode 27 and the IC chip 32, the connection is provided at the substantially longitudinal central portion of the IC chip 32 between the common electrode 27 and the common electrode wiring 61A. This makes it possible to further suppress the non-uniformity of the value of current flowing through the heating elements, thereby further reducing variation in print density.

The number of common electrode connections provided within each physical block, the location of each connection, and a connecting manner are not specifically limited. The same effect can be obtained if a plurality of connections are provided within each physical block.

Figure 16:
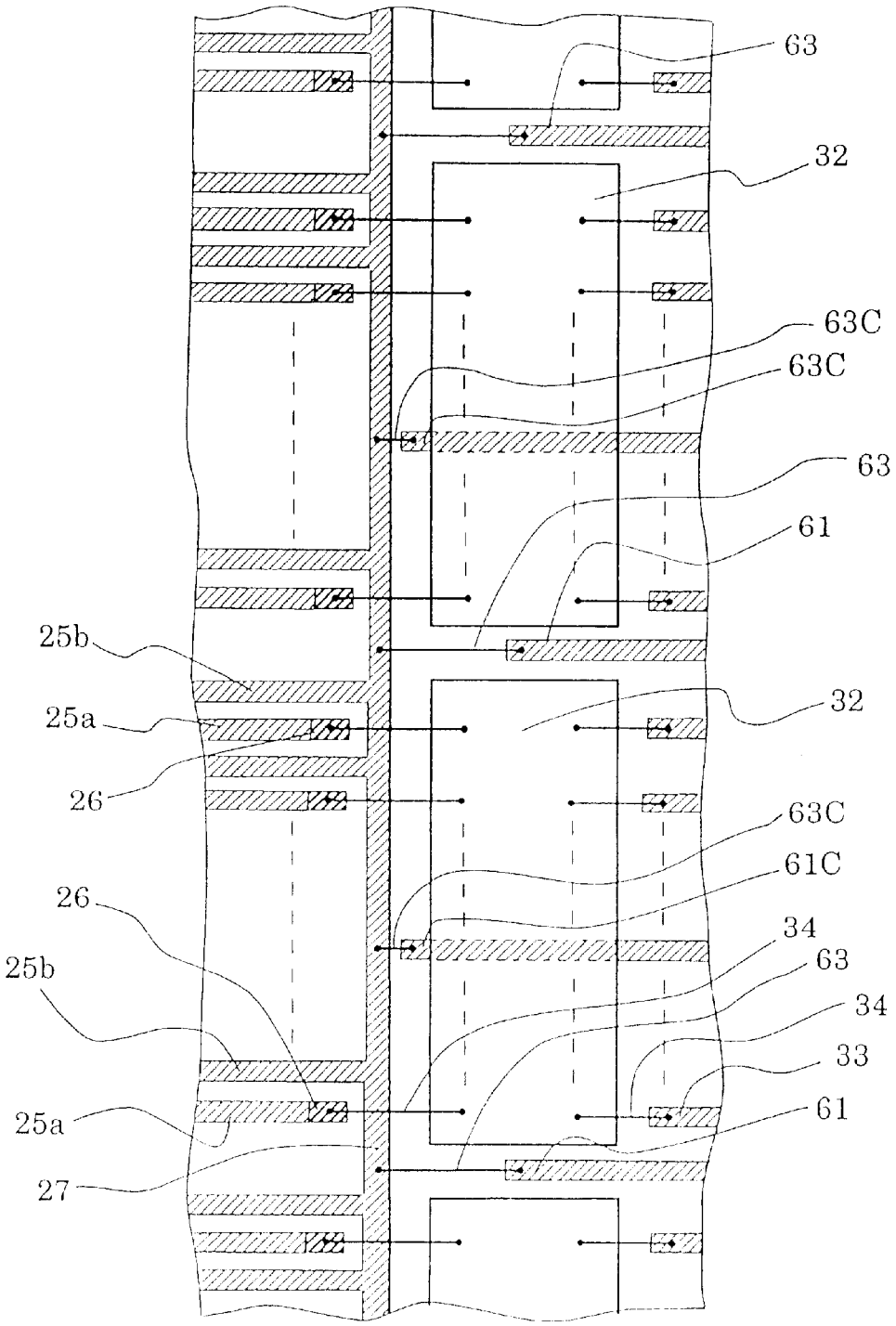
FIG. 16 is a plane view of a modified example of the wiring connection portions between the head chip and the wiring substrate in the thermal head according to the embodiment of the present invention.

For example, as shown in FIG. 16, the connection within each physical block may be carried out using a common electrode wiring 61C provided below the IC chip 32 and a bonding wire 63C in place of using the common electrode wiring 61A provided on the surface of the IC chip 32. In this case, it is possible to facilitate the wire bonding and shorten the length of the bonding wire.

Figure 17:
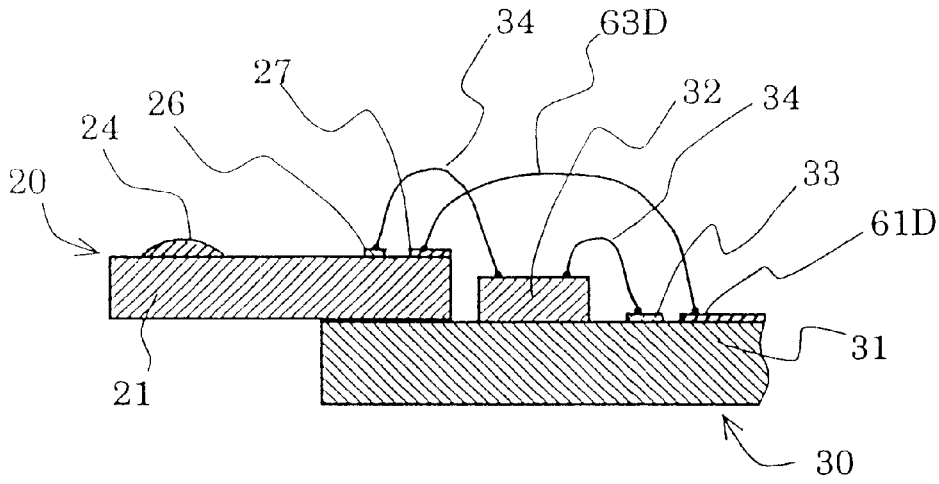
FIG. 17 is a sectional view of a modified example of the wiring connection portions between the head chip and the wiring substrate in the thermal head according to the embodiment of the present invention.

As shown in FIG. 17, a common electrode wiring 61D provided opposite from the common electrode 27 with respect to the IC chip 32 may be connected to the common electrode 27 through a bonding wire 63D extending across the IC chip 32. This case is advantageous in that a processing for providing the common electrode wiring on the IC chip 32 or the like is unnecessary.

Further, in the embodiments described above, the connection between the common electrode and the common electrode wiring is carried out using the wire bonding, but of course, the present invention is not limited there to. The connection is not specifically limited as far as it can establish the electrical connection.

Figure 18:
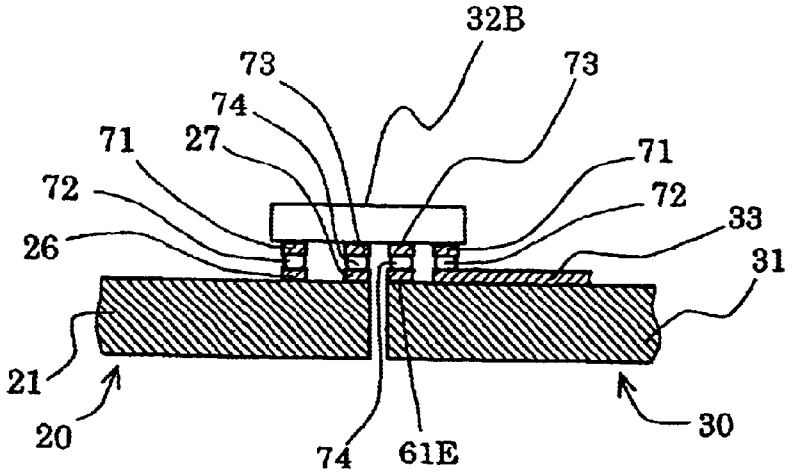
FIGS. 18(*a*)–18(*b*) are a sectional view and a plane view, respectively, of the wiring connection portions between the head chip and the wiring substrate in the thermal head according to another embodiment of the present invention.
Figure 18:
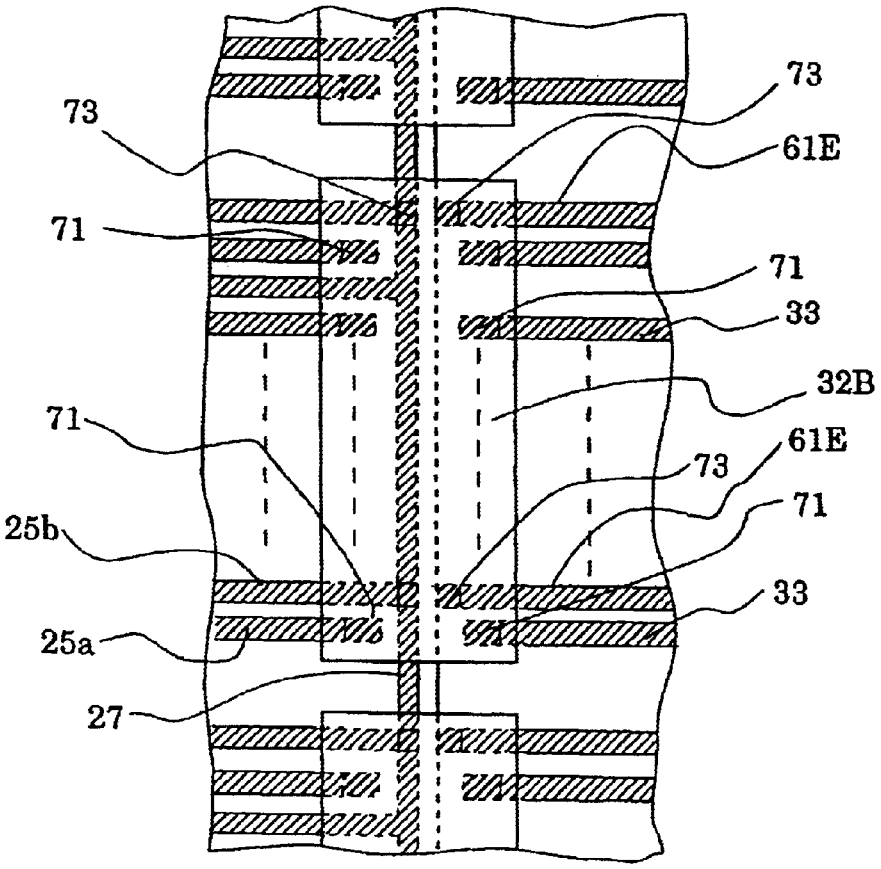
Figure 19:
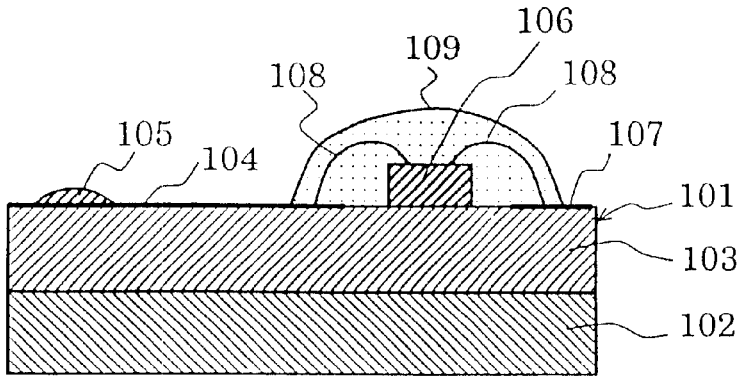
FIG. 19 is a sectional view of a thermal head in a background art.
Figure 20:
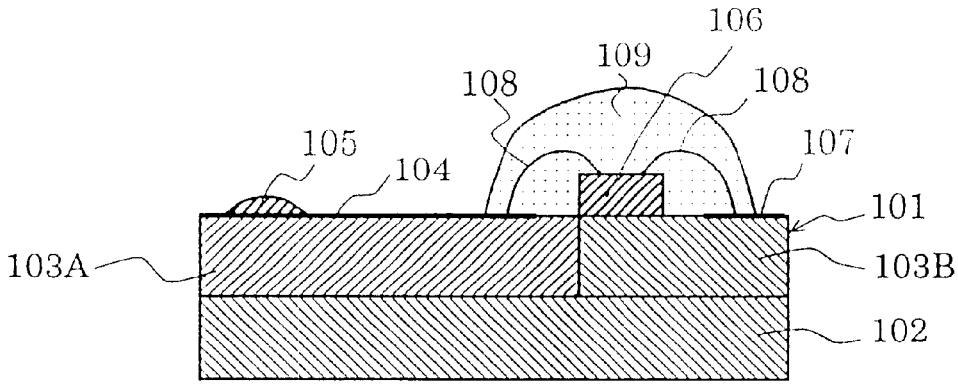
FIG. 20 is a sectional view of a thermal head in a background art.

FIGS. 18(*a*) and 18(*b*) are a sectional view and a plane view of a wiring connecting portion between the head chip and the wiring substrate in a thermal head according to another embodiment.

In the present embodiment, the height of the head chip 20 is substantially the same as the height of the wiring substrate 30, and a semiconductor integrated circuit 32B of a flip tip type are mounted onto and across the head chip 20 and the wiring substrate 30.

The terminal portion 62 on the segment electrode 25*a* connected to the heating element is connected to the external terminal 33A through a pad 71 and a bump 72 provided on the lower surface of the IC chip 32B. The IC chip 32B is provided with pads 73 short-circuited to each other for common electrode wirings, and these pads 73 are respectively connected through bumps 74 to the common electrode 27 and the common electrode wiring 61E on the wiring substrate 30. The use of the IC chip 32B of the flip tip type in this manner can dispense with the connection by the wire bonding.

Of course, the wire bonding may be used for connection between the common electrode and the common electrode wiring within the IC chip of the flip tip type.

As described above, since the common electrode of the head chip is connected to the external terminal at plural locations in the direction in which the heating elements are arrayed, it is possible to reduce the print variation while suppressing the configuration of the thermal head to be small.

INDUSTRIAL APPLICABILITY

As described above, according to the present invention, it is possible to make the head chip compact in size, enhance the productivity of the board forming process, improve the handling ability during the mounting process, and remarkably reduce the cost.

What is claimed is:

1. A thermal head unit comprising: a thermal head having a head chip, a plurality of heating elements disposed on an upper surface of the head chip at an end portion thereof, a plurality of electrodes disposed on the upper surface of the head chip and connected to the heating elements, a wiring substrate disposed on a lower surface of the head chip so that the end portion of the head chip protrudes from the wiring substrate, and a semiconductor integrated circuit mounted on the wiring substrate; a support member for supporting the thermal head, the support member having an upper step portion connected to the end portion of the head chip and a step difference portion; an adhesive agent layer disposed in a clearance formed between the step difference portion and the wiring substrate; and an adhesive layer for adhering the end portion of the head chip to the upper step portion of the support member, the adhesive agent layer being softer than the adhesive layer after the end portion of the head chip is adhered to the upper step portion of the support member and before the adhesive agent layer is hardened.

2. A thermal head unit according to claim 1; wherein the step difference portion of the support member has at least one recessed groove formed at a bottom portion thereof.

3. A thermal head unit comprising: a thermal head having a head chip, a plurality of heating elements disposed on an upper surface of the head chip at an end portion thereof, a plurality of electrodes disposed on the upper surface of the head chip and connected to the heating elements, a wiring substrate disposed on a lower surface of the head chip so that the end portion of the head chip protrudes from the wiring substrate, and a semiconductor integrated circuit mounted on the wiring substrate; a support member for supporting the thermal head, the support member having an upper step portion connected to the end portion of the head chip and a step difference portion; an adhesive agent layer disposed in a clearance formed between the step difference portion and the wiring substrate; and an adhesive layer for adhering the end portion of the head chip to the upper step portion of the support member, the adhesive agent layer having a thickness greater than that of the adhesive layer.

4. A thermal head unit according to claim 3; wherein the step difference portion of the support member has at least one recessed groove formed at a bottom portion thereof.

5. A thermal head unit comprising: a thermal head having a head chip, a plurality of heating elements disposed on an upper surface of the head chip at an end portion thereof, a plurality of electrodes disposed on the upper surface of the head chip and connected to the heating elements, a wiring substrate disposed on a lower surface of the head chip so that the end portion of the head chip protrudes from the wiring substrate, and a semiconductor integrated circuit mounted on the wiring substrate; a support member for supporting the thermal head, the support member having an upper step portion connected to the end portion of the head chip and a step difference portion having at least one recessed groove formed at a bottom portion thereof; and an adhesive agent layer disposed in a clearance formed between the step difference portion and the wiring substrate.

6. A method of manufacturing thermal heads, comprising the steps of: providing a plurality of head chips each having an upper surface, a lower surface, a plurality of heating elements disposed on the upper surface, and a plurality of electrodes disposed on the upper surface and connected to the heating elements; connecting the head chips to a wiring substrate forming plate; mounting a plurality of semiconductor integrated circuits onto the wiring substrate forming plate; connecting the electrodes of each head chip to a respective one of the semiconductor integrated circuits; and dividing the wiring substrate forming plate into a plurality of sections to form a plurality of thermal heads each having a wiring substrate connected to the lower surface of a respective one of the head chips.

7. A method according to claim 6; wherein the connecting step includes the step of orienting the head chips in one direction and in juxtaposed relation in a plurality of longitudinal and lateral rows on the wiring substrate forming plate.

8. A method according to claim 7; wherein the orienting step comprises orienting a part of each of the head chips in a direction perpendicular to a direction in which the head chips are connected to the wiring substrate forming plate.

9. A method as in one of claims 6 to 8; wherein the wiring substrate forming plate has a plurality of elongated holes penetrating therethrough, an inner peripheral surface of each of the elongated holes forming at least one end surface of a respective one of the wiring substrates.

10. A method according to claim 9; wherein the connecting step includes the step of disposing the head chips on the wiring substrate forming plate so that each of the head chips extends across two peripheral edge portions of a respective one of the elongated holes in a width direction thereof and is connected to only one of the peripheral edge portions.

11. A method according to claim 9; wherein the connecting step includes the step of disposing the head chips on the wiring substrate forming plate so that a part of each of the head chips in the width direction thereof confronts a respective one of the elongated holes.

12. A method according to claim 9; wherein the connecting step includes the step of disposing the head chips on the wiring substrate forming plate so that each of the head chips is disposed on a respective one of a peripheral edge portion of the elongated holes in the width direction of the head chip and does not confront the elongated hole.

13. A method of manufacturing a thermal head unit constructed so that a thermal head is held on a support member, the thermal head comprising a head chip having one surface on which heating elements and electrodes connected to the heating elements are provided, and a wiring substrate that is joined to the other surface of the head chip in a state that one end portion of the head chip in the width direction, which serves as a heating element forming portion, is protruded, and that mounts thereon a semiconductor integrated circuit connected to the electrodes, the thermal head unit manufacturing method characterized by comprising:

a step of supplying an adhesive agent layer to a step difference portion of the support member, the support member having an upper step portion joined to the heating element forming portion, and the step difference portion recessed more deeply than a thickness of the wiring substrate;

a step of placing the wiring substrate onto the adhesive agent layer provided to the step difference portion using as a reference a joining of the heating element forming portion to the upper step portion prior to hardening of the adhesive agent layer; and a step of subsequently hardening the adhesive agent layer.

14. A method of manufacturing a thermal head unit constructed so that a thermal head is held on a support member, the thermal head comprising a head chip having one surface on which heating elements and electrodes connected to the heating elements are provided, and a wiring substrate that is joined to the other surface of the head chip in a state that one end portion of the head chip in the width direction, which serves as a heating element forming portion, is protruded, and that mounts thereon a semiconductor integrated circuit connected to the electrodes, the thermal head manufacturing method characterized by comprising:

a step of providing a support member having an upper step portion joined to the heating element forming portion, and a step difference portion recessed more deeply than a thickness of the wiring substrate, and fixing the wiring substrate to the step difference portion using as a reference a joining of the heating element forming portion to the upper step portion while placing the wiring substrate to the step difference portion with a clearance therebetween;

a step of supplying an adhesive agent to the clearance; and a step of subsequently hardening the adhesive agent layer.

15. A thermal head comprising: a head chip having a first thickness, a first surface, and a second surface opposite the first surface; a plurality of heating elements disposed on the first surface of the head chip at a first end portion thereof; a plurality of electrodes disposed on the first surface of the head chip and connected to the heating elements; a wiring substrate disposed on the second surface of the head chip; a semiconductor integrated circuit mounted on the wiring substrate and having a second thickness smaller than the first thickness; a common electrode extending in a longitudinal direction along a second end portion of the head chip disposed opposite to the first end portion; a plurality of common electrode wirings disposed on the wiring substrate; and a plurality of connection wirings connecting the common electrode to the common electrode wirings and disposed at a plurality of locations in the longitudinal direction along the first end portion of the head chip.

16. A thermal head according to claim 15; wherein an end of the head chip in a width direction thereof protrudes from the wiring substrate.

17. A thermal head according to claim 15; wherein an amount by which the head chip protrudes from the wiring substrate is 20% to 70% of the width of the head chip.

18. A thermal head according to claim 15; wherein the head chip does not protrude from the wiring substrate in the width direction thereof.

19. A thermal head according to claim 15; wherein an end of the wiring substrate in the width direction thereof protrudes from an end of the head chip in a width direction thereof.

20. A thermal head unit comprising: a support member; and a thermal head according to claim 15 mounted on the support member.

21. A thermal head comprising: a head chip having an upper surface, a lower surface and a side surface; a plurality of heating elements disposed on the upper surface of the head chip; a plurality of electrodes disposed on the upper surface of the head chip and connected to the heating elements; a wiring substrate disposed on the lower surface of the head chip; a plurality of semiconductor integrated circuits each mounted on the wiring substrate and disposed in contact with the side surface of the head chip and connected to respective ones of the electrodes; a common electrode extending in a longitudinal direction along a first end portion of the head chip disposed opposite to a second end portion in a width direction thereof on which the heating elements are disposed; a plurality of common electrode wirings disposed on the wiring substrate; and a plurality of connection wirings connecting the common electrode to the common electrode wirings and disposed at a plurality of locations in the longitudinal direction along the first end portion of the head chip.

22. A thermal head according to claim 21; wherein at least one of the connection wirings is disposed between one adjacent pair of the semiconductor integrated chips.

23. A thermal head according to claim 21; wherein each of the connection wirings is disposed between respective ones of adjacent pairs of the semiconductor integrated chips.

24. A thermal head according to claim 21; wherein each of the connection wirings is disposed within a respective one of the semiconductor integrated chips.

25. A thermal head comprising: a head chip having a first thickness, a first surface, and a second surface opposite the first surface; a plurality of heating elements disposed on the first surface of the head chip; a plurality of electrodes disposed on the first surface of the head chip and connected to the heating elements; a wiring substrate disposed on the second surface of the head chip; a semiconductor integrated circuit mounted on the wiring substrate and having a second thickness smaller than the first thickness; a common electrode extending in a longitudinal direction along a first end portion of the head chip disposed opposite to a second end portion in a width direction thereof on which the heating elements are disposed; a plurality of common electrode wirings disposed on the wiring substrate; and a plurality of connection wirings connecting the common electrode to the common electrode wirings and disposed at a plurality of locations in the longitudinal direction along the first end portion of the head chip.

26. A thermal head comprising: a head chip having an upper surface, a lower surface and a side surface; a plurality of heating elements disposed on the upper surface of the head chip; a plurality of electrodes disposed on the upper surface of the head chip and connected to the heating elements; a wiring substrate disposed on the lower surface of the head chip; a plurality of semiconductor integrated circuits each mounted on the wiring substrate and connected to respective ones of the electrodes; a common electrode extending in a longitudinal direction along a first end portion of the head chip disposed opposite to a second end portion in a width direction thereof on which the heating elements are disposed; a plurality of common electrode wirings disposed on the wiring substrate; and a plurality of connection wirings connecting the common electrode to the common electrode wirings and disposed at a plurality of locations in the longitudinal direction along the first end portion of the head chip, at least one of the connection wirings being disposed between one adjacent pair of the semiconductor integrated circuits.

27. A thermal head according to claim 26; wherein each of the connection wirings is disposed between respective ones of adjacent pairs of the semiconductor integrated circuits.

28. A thermal head comprising: a head chip having an upper surface, a lower surface and a side surface; a plurality of heating elements disposed on the upper surface of the head chip; a plurality of electrodes disposed on the upper surface of the head chip and connected to the heating elements; a wiring substrate disposed on the lower surface of the head chip; a plurality of semiconductor integrated circuits each mounted on the wiring substrate and connected to respective ones of the electrodes; a common electrode extending in a longitudinal direction along a first end portion of the head chip disposed opposite to a second end portion in a width direction thereof on which the heating elements are disposed; a plurality of common electrode wirings disposed on the wiring substrate; and a plurality of connection wirings connecting the common electrode to the common electrode wirings and disposed at a plurality of locations in the longitudinal direction along the first end portion of the head chip, each of the connection wirings being disposed within a respective one of the semiconductor integrated circuits.

* * * * *